US009959844B2

(12) United States Patent
Dunlop et al.

(10) Patent No.: US 9,959,844 B2
(45) Date of Patent: May 1, 2018

(54) CAPO DEVICE

(71) Applicants: James Andrew Dunlop, Benicia, CA (US); Jeff Burnham, Benicia, CA (US); Jim Dunlop, Benicia, CA (US)

(72) Inventors: James Andrew Dunlop, Benicia, CA (US); Jeff Burnham, Benicia, CA (US); Jim Dunlop, Benicia, CA (US)

(73) Assignee: Dunlop Manufacturing Inc., Benicia, CA (US)

( * ) Notice: Subject to any disclaimer, the term of this patent is extended or adjusted under 35 U.S.C. 154(b) by 0 days. days.

(21) Appl. No.: 14/060,523

(22) Filed: Oct. 22, 2013

(65) Prior Publication Data

US 2015/0107436 A1 Apr. 23, 2015

(51) Int. Cl.
*G10D 3/00* (2006.01)
*G10D 3/04* (2006.01)

(52) U.S. Cl.
CPC ..... *G10D 3/043* (2013.01)

(58) Field of Classification Search
USPC ..... 84/318, 290
See application file for complete search history.

(56) References Cited

U.S. PATENT DOCUMENTS

| | | | | | |
|---|---|---|---|---|---|
| 3,914,830 | A * | 10/1975 | Bolton | B25B 1/125 | 24/490 |
| 3,933,077 | A | 1/1976 | Dunlop | | |
| 5,117,723 | A * | 6/1992 | Veenschoten | G10D 3/043 | 84/318 |
| 5,284,077 | A | 2/1994 | Ellis | | |
| 5,431,080 | A * | 7/1995 | Wiesenthal | 84/318 | |
| 5,492,045 | A * | 2/1996 | Roblee | 84/318 | |
| 6,459,025 | B1 * | 10/2002 | D'Addario | G10D 3/043 | 84/318 |
| 6,573,440 | B1 * | 6/2003 | Rodriguez | 84/318 | |
| 7,973,227 | B2 * | 7/2011 | Paige | 84/318 | |
| 8,324,490 | B1 * | 12/2012 | Walworth | 84/318 | |
| 2011/0023683 | A1 * | 2/2011 | Vochezer | G10D 3/043 | 84/318 |
| 2014/0013924 | A1 * | 1/2014 | Campling | G10D 3/043 | 84/318 |

* cited by examiner

*Primary Examiner* — Christopher Uhlir
(74) *Attorney, Agent, or Firm* — West & Associates, a PC; Stuart J. West

(57) ABSTRACT

A capo device for selectively altering the pitch range of a stringed instrument, the capo device being adapted to engage a variety of stringed instrument neck sizes and/or geometries while maintaining desired sound and pitch quality.

14 Claims, 2 Drawing Sheets

CAPO DEVICE

BACKGROUND

Field of the Invention

The present disclosure relates to the field of musical instrument accessories, specifically a capo device for selectively altering the pitch of a guitar or other stringed instrument.

Background

Stringed instruments allow a player to selectively press a string against a fret board, neck, fingerboard, or the like, at different points along the string in order to produce certain tones or notes upon simultaneous strumming of the string. With multiple strings available for successive or simultaneous manipulation, a player can thus produce chords and melodies within the original pitch range for a particular instrument. However, it is often desirable to adjust the pitch of the entire instrument without permanent alteration, such that a player can then manipulate the instrument's strings to temporarily produce chords and melodies within a different pitch range.

A capo device allows a player of a stringed instrument, such as a guitar, to temporarily adjust the pitch of the instrument by pressing all strings of the instrument against a fret board at a desired point along the length of the fret board and locking in place, freeing the player's hand to manipulate the strings below the capo device. However, traditional capo devices can only properly be used with one size of stringed instrument neck. An ill-fitting capo device inhibits application of proper force applied to instrument strings, resulting in undesirable sound and pitch effects. Therefore, with traditional capo devices, a musician must own a different capo device for each stringed instrument for which a capo device is desired.

What is needed is a capo device adapted to properly engage a variety of stringed instrument neck sizes. The capo device can have a pivoting member adapted to center the force applied to instrument strings when used across a range of instrument neck sizes.

DETAILED DESCRIPTION

Figure 1:
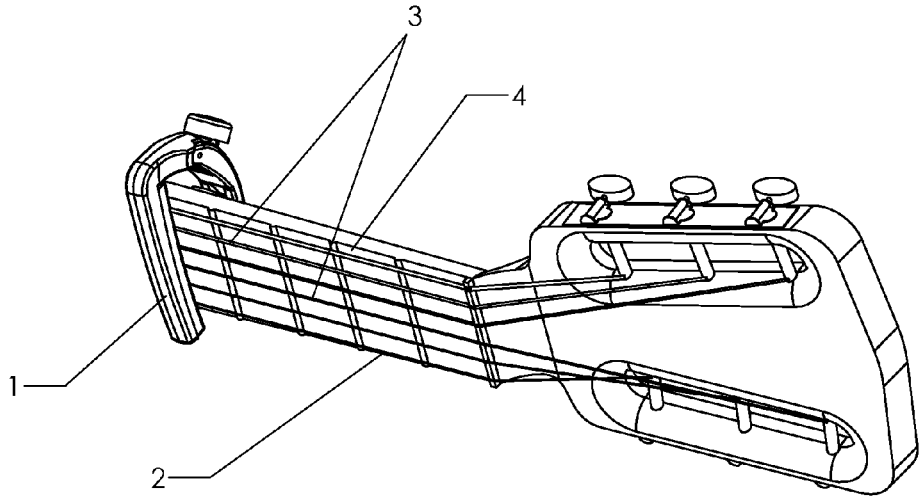
FIG. 1 depicts a perspective view of one embodiment of the present device in use on the neck of a guitar.

FIG. 1 depicts a perspective view of one embodiment of the present capo device 1 in use on a guitar neck 2. A capo device 1 can be substantially U-shaped, such that it can wrap around a guitar neck 2 and can be detachably coupled to a guitar neck 2, instrument strings 3, and/or a fret board 4. In other embodiments, a capo device 1 can be a substantially closed loop such that it can substantially encircle a guitar neck 2 in use. In yet other embodiments, a capo device 1 can have any other known and/or convenient geometry. In use, a capo device 1 can be detachably coupled substantially orthogonal to the length of a guitar neck 2, instrument strings 3, and/or a fret board 4. In other embodiments, a capo device 1 can be used on a guitar neck 2 in any other known and/or convenient manner and/or configuration.

Figure 2:
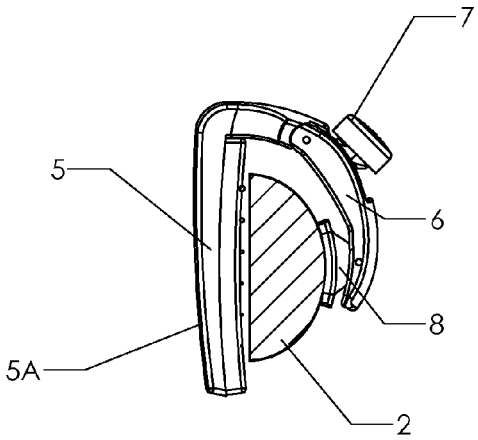
FIG. 2 depicts a transverse cross-sectional view of one embodiment of the present device in use on a guitar neck of relatively substantial girth.

FIG. 2 depicts a transverse cross-sectional view of one embodiment of the present capo device 1 in use on a guitar neck 2 of relatively substantial girth. A capo device 1 can have a first extension member 5 comprising a proximal end, a distal end, an inner surface, and an outer surface. A first extension member 5 can be adapted to extend across the width of a guitar neck 2 and, in some embodiments, a first extension member 5 can have a length equal to or greater than the width of a guitar neck 2. In some embodiments, a first extension member 5 can be substantially linear, while in other embodiments a first extension member 5 can be L-shaped, convex, concave, hyperbolic, or can have any other known and/or convenient geometry. In some embodiments, a first extension member 5 can be elastomeric, rigid, flexible, and/or pliable. As depicted in FIG. 2, in some embodiments a first extension member 5 can partially extend toward the back of a guitar neck 2 when in use. A first extension member 5 can be made of metal, plastic, wood, polymer, and/or any other known and/or convenient material and/or combination of materials. In some embodiments, a first extension member 5 can be selectively detachable from a capo device 1. Moreover, in some embodiments a first extension member 5 can have a smooth surface, while in other embodiments the surface of a first extension member 5 can have ridges, bumps, or any other desired texture. In yet other embodiments, a first extension member 5 can be at least partially comprised of magnetic and/or hook and loop material and/or a pocket or compartment such that a guitar pic or other desired item can be temporarily stored on or in a capo device 1. In some embodiments, a first extension member 5 can comprise a customizable name or logo plate, and/or can be any desired color or combination of colors. In alternate embodiments, a first extension member 5 can have waterproof, water-resistant, anti-microbial, anti-bacterial, and/or phosphorescent properties.

As shown in FIGS. 2, 3, 4, & 5, in some embodiments, a first extension member 5 can be coupled with a first outer component 5A. In some embodiments, a first outer component 5A can be substantially linear, convex, concave, or hyperbolic, and can extend across the width and/or length of a first extension member 5. In other embodiments a first outer component 5A can extend around substantially all outer surfaces of a capo device 1. In yet alternate embodiments, a first outer component 5A can have any other known and/or convenient configuration, size, and/or geometry. A first outer component 5A can be a coating, layer, film, or sealant, and can be elastomeric, rigid, flexible, or pliable. A first outer component 5A can be comprised of polymer, wood, metal, plastic, and/or any other known and/or convenient material or combination of materials. In some embodiments, a first outer component 5A can have a smooth surface, while in other embodiments the surface of a first outer component 5A can have ridges, bumps, or any other desired texture. In yet other embodiments, a first outer component 5A can be at least partially comprised of magnetic and/or hook and loop material and/or a pocket or compartment such that a guitar pic or other desired item can be temporarily stored on or in a capo device 1. Moreover, a first outer component 5A can be permanently or detachably coupled with a first extension member 5 via adhesive, hook and loop, snaps, thermal bonding, or any other known and/or convenient method. In some embodiments, a first outer component 5A can be a customizable name or logo plate, and/or can be any desired color or combination of colors. In some embodiments, multiple first outer components 5A can be interchangeable such that a capo device 1 can be customized as desired. In yet alternate embodiments, a first outer component 5A can have waterproof, water-resistant, anti-microbial, anti-bacterial, and/or phosphorescent properties.

Figure 3:
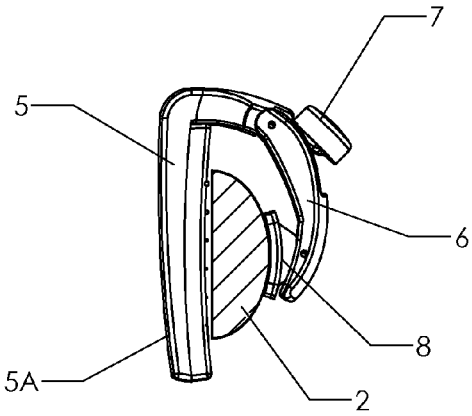
FIG. 3 depicts a transverse cross-sectional view of one embodiment of the present device in use on a guitar neck of relatively minimal girth.

Referring to FIGS. 2 & 3, a capo device 1 can have a second extension member 6 comprising a distal end, a proximal end, an inner surface, and an outer surface. The distal end of a first extension member 5 can be pivotally coupled to the distal end of a second extension member 6 via a ball joint, hinge, or any other known and/or convenient mechanism. An adjustment mechanism 7 can be adapted to selectively loosen and/or tighten the connection between a first extension member 5 and a second extension member 6 and can be comprised of a tension knob, clamp, quick-release lever, or any other known and/or convenient mechanism. In other embodiments, a first extension member 5 and second extension member 6 can be coupled in any other known and/or convenient manner, and the connection between the a first extension member 5 and second extension member 6 can be selectively adjusted via any other known and/or convenient mechanism. A second extension member 6 can be concave, convex, hyperbolic, substantially linear, L-shaped, or can have any other known and/or convenient geometry. A second extension member 6 can extend at least partially around a guitar neck 2, as shown in FIGS. 2 & 3, and can be made of metal, plastic, wood, polymer, and/or any other known and/or convenient material and/or combination of materials. A second extension member 6 can be can have a smooth surface, while in other embodiments the surface of a second extension member 6 can have ridges, bumps, or any other desired texture. In yet other embodiments, a second extension member 6 can be at least partially comprised of magnetic and/or hook and loop material and/or a pocket or compartment such that a guitar pic or other desired item can be temporarily stored on or in a capo device 1. In some embodiments, a second extension member 6 can comprise a customizable name or logo plate, and/or can be any desired color or combination of colors. In yet alternate embodiments, a second extension member 6 can have waterproof, water-resistant, anti-microbial, anti-bacterial, and/or phosphorescent properties.

Referring to FIGS. 2 & 3, the inner surface of a second extension member 6 can be permanently or detachably coupled with a support member 8 that can extend substantially toward the inner surface of a first extension member 5 and/or a guitar neck 2 when in use. In some embodiments, a support member 8 can be adapted to rotate, pivot, and/or move in a linear fashion with respect to a second extension member 6, and can be located substantially proximate to the proximal end of a second extension member 6. A support member 8 can be coupled with a second extension member 6 via a ball joint, hinge, pivot pin, or any other known and/or convenient bearing, mechanism, or device. In yet other embodiments, a support member 8 can be coupled with a second extension member 6 via flexible, moveable, and/or pliable bonding material, rather than or in addition to the aforementioned coupling mechanisms, such that a support member 8 can move in at least one direction when force is applied. Moreover, a support member 8 can be conical, cylindrical, or can have any other known and/or convenient geometry, and can have convex, concave, hyperbolic, and/or substantially linear surfaces. In yet additional embodiments, a support member 8 can be made of metal, plastic, wood, polymer, phosphorescent material and/or any other known and/or convenient material and/or combination of materials, and can be elastomeric, rigid, or flexible.

A support member 8 can be adapted to provide stability of a capo device 1 when in use on a stringed instrument, preventing a capo device 1 from moving or slipping unintentionally. Moreover, a support member 8 can center the force applied by a capo device 1, a first extension member 5, and/or a second extension member 6 on a guitar neck 2, instrument strings 3, and/or fret board 4, thereby creating even pressure on instrument strings 3 and optimizing sound, pitch, and tone quality. In some embodiments, a support member 8 can be adapted for use with a wide range of guitar neck 2 sizes and varying geometries, while maintaining sound quality and integrity. For instance, FIG. 2 depicts a capo device 1 in use on a guitar neck 2 of relatively substantial girth, whereas FIG. 3 depicts a capo device 1 in use on a guitar neck 2 of relatively minimal girth. In yet other embodiments, a support member 8 can be adapted to perform any other known and/or convenient function.

As depicted in FIGS. 4, 4A, 5, & 5A, in some embodiments the inner surface of a first extension member 5 can be permanently or detachably coupled with a first elastomeric member 9. A first elastomeric member 9 can be adapted to dampen vibrational forces between a capo device 1 and a fret board 4 and/or instrument strings 3 when in use, thereby minimizing undesirable sound, pitch, and tone. In some embodiments, a first elastomeric member 9 can also act as a cushion against instrument strings 3 and/or a fret board 4 to minimize potential wear and tear of instrument strings 3 and/or a fret board 4.

A first elastomeric member 9 can be coupled with a first extension member 5 via temporary or permanent adhesive, hook and loop, thermal bonding, magnets, or any other known and/or convenient method or mechanism. A first elastomeric member 9 can be a strip or pad of material of substantially similar size as a side of a first extension member 5 and/or the width of a guitar neck 2 and/or fret board 4. In some embodiments, a first elastomeric member 9 can be convex, concave, hyperbolic, or substantially linear. In yet other embodiments, a first elastomeric member 9 can have any other geometry and/or size relative to a first extension member 5, guitar neck 2, and/or fret board 4. In some embodiments, a first elastomeric member 9 can be made of polymer, foam, silicone, and/or any other known and/or convenient material. A first elastomeric member 9 can be replaceable and/or interchangeable with additional elastomeric members 9. In additional embodiments, a first elastomeric member 9 can have waterproof, water-resistant, anti-microbial, anti-bacterial, and/or phosphorescent properties.

Referring to FIGS. 4, 4A, 5, & 5A, a support member 8 can be permanently or detachably coupled with a second elastomeric member 10 via temporary or permanent adhesive, hook and loop, thermal bonding, magnets, or any other known and/or convenient method or mechanism. A second elastomeric member 10 can be coupled with a portion of a support member 8 opposite a second extension member 6, such that a second elastomeric member 10 can be selectively coupled with a guitar neck 2 when in use. A second elastomeric member 10 can be adapted to dampen vibrational forces between a capo device 1 and a guitar neck 2 when in use, thereby minimizing undesirable sounds, pitch, or tone. In some embodiments a second elastomeric member 10 can also act as a cushion against a guitar neck 2 to minimize potential wear and tear of a guitar neck 2.

A second elastomeric member 10 can be a strip or pad of material of substantially similar size as a surface of a support member 8 or the width of a guitar neck 2. In some embodiments, a second elastomeric member 10 can be convex, concave, hyperbolic, or substantially linear. In other embodiments, a second elastomeric member 10 can have any other geometry and/or size relative to a support member 8 and/or guitar neck 2. In some embodiments, a second elastomeric member 10 can be made of polymer, foam, silicone, and/or any other known and/or convenient material. In alternate embodiments, a second elastomeric member 10 can have waterproof, water-resistant, anti-microbial, anti-bacterial, and/or phosphorescent properties.

Figure 4:
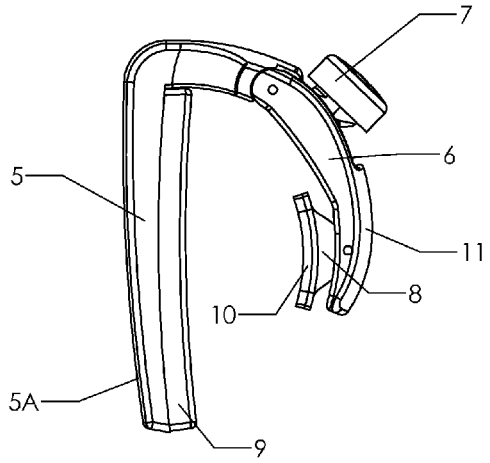
FIG. 4 depicts a side view of one embodiment of the present device in a closed position.
Figure 4A:
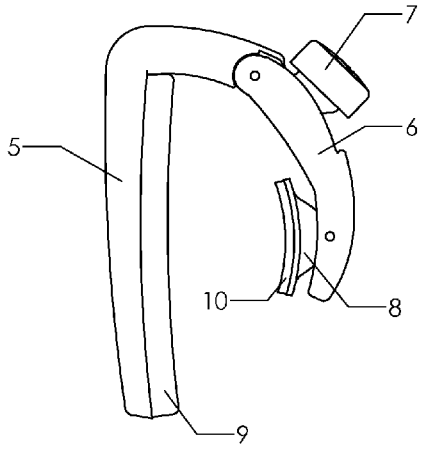
FIG. 4A depicts a side view of an alternate embodiment of the present device in a closed position.
Figure 5:
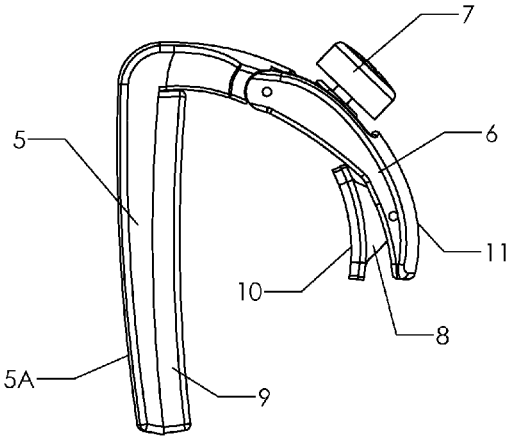
FIG. 5 depicts a side view of one embodiment of the present device in an open position.
Figure 5A:
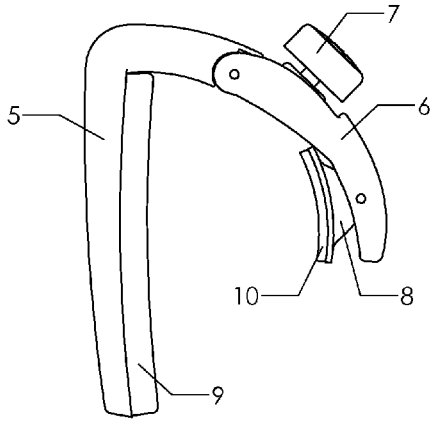
FIG. 5A depicts a side view of an alternate embodiment of the present device in an open position.

Referring to FIGS. 4 & 5, in some embodiments a second outer component 11 can be permanently or detachably coupled with the outer surface of a second extension member 6 via temporary or permanent adhesive, hook and loop, thermal bonding, magnets, or any other known and/or convenient method or mechanism. In some embodiments, a second outer component 11 can be substantially linear, convex, concave, or hyperbolic, and can extend across the width and/or length of a second extension member 6. In other embodiments a second outer component 11 can extend around substantially all outer surfaces of a capo device 1. In yet alternate embodiments, a second outer component 11 can have any other known and/or convenient configuration, size, and/or geometry. A second outer component 11 can be a coating, layer, film, or sealant, and can be elastomeric, rigid, flexible, or pliable. A second outer component 11 can be comprised of polymer, wood, metal, plastic, and/or any other known and/or convenient material or combination of materials. In some embodiments, a second outer component 11 can have a smooth surface, while in other embodiments the surface of a second outer component 11 can have ridges, bumps, or any other desired texture. In yet other embodiments, a second outer component 11 can be at least partially comprised of magnetic and/or hook and loop material and/or a pocket or compartment such that a guitar pic or other desired item can be temporarily stored on or in a capo device 1. In some embodiments, a second outer component 11 can be a customizable name or logo plate, and/or can be any desired color or combination of colors. In some embodiments, multiple second outer components 11 can be interchangeable such that a capo device 1 can be customized as desired. In yet further embodiments, a second outer component 11 can be adapted to provide additional strength, stability, and/or support to a second extension member 6 and/or an adjustment mechanism 7. Moreover, a second outer component 11 can have waterproof, water-resistant, anti-microbial, anti-bacterial, and/or phosphorescent properties.

In use, a capo device 1 in an open position (see FIGS. 5 & 5A) can be applied to a guitar neck 2 by placing a first extension member 5 laterally over instrument strings 3 and a fret board 4 at a desired location, such that a first elastomeric member 9 can be in contact with instrument strings 3 and a fret board 4, and a second extension member 6 can wrap around a guitar neck 2. An adjustment mechanism 7 can then be manipulated to coax a capo device 1 into a closed position (see FIGS. 2-4A), such that a support member 8 and a second elastomeric member 10 can be temporarily coupled with a guitar neck 2. When a capo device 1 is tightened against a guitar neck 2, a support member 8 can pivot to a position that will best stabilize a capo device 1. The degree to which a support member 8 pivots can depend on the size, girth, and/or geometry of a guitar neck 2. An adjustment mechanism 7 can be further manipulated to tighten the connection between a first extension member 5 and a second extension member 6, such that a desired amount of force can be applied to instrument strings 3 and a fret board 4 by a first extension member 5 and a first elastomeric member 9, and to a guitar neck 2 by a second extension member 6, a support member 8, and a second elastomeric member 10. Once the aforementioned steps have been completed, a guitar can thereafter be played in a pitch range different from that of the guitar's original design. In other embodiments, a capo device 1 can be used with any other known and/or convenient stringed instrument. In yet further embodiments, a capo device 1 can be used in any other known and/or convenient manner.

Although the method has been described in conjunction with specific embodiments thereof, it is evident that many alternatives, modifications and variations will be apparent to those skilled in the art. Accordingly, the method as described and hereinafter claimed is intended to embrace all such alternatives, modifications and variations that fall within the spirit and broad scope of the appended claims.

What is claimed is:

1. A capo device for stringed instruments, comprising:

a first extension member having a first portion and a second portion, said first portion and said second portion being in a substantially L-shaped configuration;

a second extension member pivotally coupled with said first extension member at a hinged joint positioned proximate to an end of said second portion of said first extension member and an end of said second extension member;

an adjustment mechanism comprising a tension knob having a substantially central longitudinal axis and coupled with said second extension member, such that the substantially central longitudinal axis of said tension knob remains stationary with respect to said second extension member;

and a support member pivotally coupled with said second extension member, wherein said support member extends from said second extension member substantially toward said first portion of said first extension member, wherein movement of said tension knob causes rotational movement of said first extension member about said hinged joint relative to said second extension member to move said first extension member and said second extension member between an open position and a closed position.

2. The capo device of claim 1, further comprising an elastomeric member coupled with said first portion of said first extension member, such that said elastomeric member faces toward second extension member.

3. The capo device of claim 1, further comprising an elastomeric member coupled with said support member such that said elastomeric member faces toward said first portion of said first extension member.

4. The capo device of claim 1, wherein said support member is pivotally coupled with said second extension member via a ball joint.

5. The capo device of claim 1, wherein said support member is pivotally coupled with said second extension member via a pivot pin engaged with said second extension member.

6. The capo device of claim 1, further comprising an outer component coupled with a surface of said first extension member.

7. The capo device of claim 1, further comprising an outer component coupled with a surface of said second extension member.

8. The capo device of claim 1, wherein a surface of said support member facing substantially toward said first portion of said first extension member is concave.

9. A capo device for stringed instruments, comprising:

a first extension member, a second extension member pivotally coupled with said first extension member at a hinged joint, such that said first extension member and said second extension member form a substantially U-shaped frame;

an adjustment mechanism coupled with said first and second extension members, said adjustment mechanism comprising a tension knob having a substantially central longitudinal axis and coupled with said second extension member, such that the substantially central longitudinal axis of said tension knob remains stationary with respect to said second extension member;

and a support member pivotally coupled with said second extension member, said support member extending from said second extension member substantially toward the center of said substantially U-shaped frame, wherein said first extension member is configured to detachably couple with a first side of an object inserted into the center of said substantially U-shaped frame and said support member is configured to detachably couple with an opposing side of said object when said object is within the center of said substantially U-shaped frame, and wherein movement of said tension knob causes rotational movement of said first extension member about said hinged joint relative to said second extension member to move said first extension member and said second extension member between an open position and a closed position and thereby selectively tighten or loosen said first extension and said second extension member around said object substantially within the center of said substantially U-shaped frame.

10. The capo device of claim 9, further comprising an elastomeric member coupled with said first extension member, said elastomeric member having a surface facing substantially towards the center of said substantially U-shaped frame.

11. The capo device of claim 9, further comprising an elastomeric member coupled with said support member, said elastomeric member having a surface facing substantially towards the center of said substantially U-shaped frame.

12. The capo device of claim 9, wherein said support member is pivotally coupled with said second extension member via a ball joint.

13. The capo device of claim 9, wherein said support member is pivotally coupled with said second extension member via a pivot pin engaged with said second extension member.

14. The capo device of claim 9, wherein a surface of said support member facing substantially toward the center of said substantially U-shaped frame is concave.

* * * * *